US006828741B1

(12) United States Patent
Shiro et al.

(10) Patent No.: US 6,828,741 B1
(45) Date of Patent: Dec. 7, 2004

(54) DEFLECTING YOKE APPARATUS AND TELEVISION RECEIVER

(75) Inventors: Yusaku Shiro, Fukaya (JP); Takayoshi Tomioka, Osato-gun (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/821,982

(22) Filed: Apr. 12, 2004

(30) Foreign Application Priority Data

Jun. 6, 2003 (JP) ..... 2003-162632

(51) Int. Cl.[7] ..... G09G 1/04

(52) U.S. Cl. ..... 315/368.11; 315/368.19; 315/368.26; 315/368.28; 315/370; 315/371

(58) Field of Search ..... 315/368.11–371

(56) References Cited

U.S. PATENT DOCUMENTS 6,160,363 A * 12/2000 Sugimoto et al. ..... 315/368.28
6,573,668 B1 6/2003 Tagami
6,759,815 B2 * 7/2004 Tagami ..... 315/368.11

FOREIGN PATENT DOCUMENTS

| | | |
|---|---|---|
| JP | 7-193831 | 7/1995 |
| JP | 11-167884 | 6/1999 |
| JP | 2000-41264 | 2/2000 |
| JP | 2001-101983 | 4/2001 |

* cited by examiner

*Primary Examiner*—Ramon M. Barrera
(74) *Attorney, Agent, or Firm*—Pillsbury Winthrop LLP

(57) ABSTRACT

A deflecting yoke apparatus comprising first and second frame coils configured to correct a vertical horizontal misconvergence first and second main coils and first and second sub-coils which are wound around a core and configured to deflect in a vertical direction electron beams which have passed through a magnetic field generated by the first and second frame coils, a first deflecting current supply portion configured to pass a serriform deflecting current to the first and second main coils, and a second deflecting current supply portion configured to supply to the first and second sub-coils through a first and second diodes connected in parallel so as to have opposed directions a deflecting current which is supplied to the first and second main coils by the first deflecting current supply portion.

20 Claims, 6 Drawing Sheets

DEFLECTING YOKE APPARATUS AND TELEVISION RECEIVER

CROSS-REFERENCE TO RELATED APPLICATIONS

This application is based upon and claims the benefit of priority from prior Japanese Patent Application No. 2003-162632, filed Jun. 6, 2003, the entire contents of which are incorporated herein by reference.

BACKGROUND OF THE INVENTION

1. Field of the Invention

The present invention relates to an improvement in a deflecting yoke apparatus used in a cathode ray tube of, e.g., a color television receiver or a color display apparatus. Further, the present invention relates to a television receiver using the above-described deflecting yoke apparatus.

2. Description of the Related Art

As is well known, the above-described deflecting yoke apparatus controls in such a manner that respective electron beams R (Red), G (Green) and B (Blue) corresponding to three primary colors emitted from an electron gun scan along a fixed path on a fluorescent screen by applying deflection in a horizontal direction and a vertical direction to the respective electron beams R, G and B.

This deflecting yoke apparatus comprises a separator formed in a substantially conical shape, and generates to a horizontal deflecting coil provided on the inner side of the separator and a vertical deflecting coil provided on the outer side of the same a magnetic field by passing serriform deflecting currents synchronized with horizontal and vertical cycles, thereby giving deflection to the respective electron beams R, G and B by using this magnetic field.

Meanwhile, in this type of deflecting yoke apparatus, if a vertical direction in a screen is determined as a Y axis, there are generated a Y axis (vertical) horizontal misconvergence YH (Horizontal) that the electron beams R and B produce a displacement in a lateral direction with the Y axis therebetween and a Y axis (vertical) vertical misconvergence VCR (Vertical Convergence Ratio) that the electron beams G produce a displacement with respect to the electron beams R and B.

Therefore, in general, a frame coil is provided to the deflecting yoke apparatus in order to correct the displacement of the three types of electron beams R, G and B on the fluorescent screen. As this frame coil, there are a YH coil used to correct the Y axis horizontal misconvergence YH and a VCR coil used to correct the Y axis vertical misconvergence VCR.

However, it is actually difficult to correct the Y axis horizontal misconvergence YH to a practically sufficient level due to a collapse of a waveform of current provoked when a reverse current is led to the YH coil in a vertical blanking period. As a result, there is generated a problem that an image quality is deteriorated.

Each of Jpn. Pat. Appln. KOKAI No. 11-167884, Jpn. Pat. Appln. KOKAI No. 7-193831, Jpn. Pat. Appln. KOKAI No. 2001-101983 and Jpn. Pat. Appln. KOKAI No. 2000-41264 discloses a structure to correct the Y axis horizontal misconvergence YH. However, these laid-open publications do not have a description about dealing with a deterioration in an image quality caused when a reverse current is led to the YH coil used to correct the Y axis horizontal misconvergence YH in the vertical blanking period at all.

BRIEF SUMMARY OF THE INVENTION

According to one aspect of the present invention, there is provided a deflecting yoke apparatus comprising: first and second frame coils configured to correct a vertical horizontal misconvergence in a screen; first and second main coils which are wound around a core and configured to deflect in a vertical direction electron beams which have passed through a magnetic field generated by the first and second frame coils; first and second sub-coils which are wound around the core and configured to deflect in the vertical direction the electron beams which have passed through the magnetic field generated by the first and second frame coils; a first deflecting current supply portion configured to pass a serriform deflecting current to the first and second main coils; and a second deflecting current supply portion configured to supply to the first and second sub-coils through a first and second diodes connected in parallel so as to have opposed directions a deflecting current which is supplied to the first and second main coils by the first deflecting current supply portion.

According to another aspect of the present invention, there is provided a television receiver comprising: a reception portion configured to receive a television broadcast signal; a signal processing portion configured to generate a video signal from the television broadcast signal received by the reception portion; a deflecting current generation portion configured to generate a deflecting current from the television broadcast signal received by the reception portion; a deflecting yoke portion configured to generate a magnetic field which deflects electron beams by using the deflecting current generated by the deflecting current generation portion; and a display portion configured to display the video signal generated by the signal processing portion as a screen image by deflecting the electron beams by using the magnetic field generated by the deflecting yoke portion, the deflecting yoke portion comprising: first and second frame coils configured to correct a vertical horizontal misconvergence in the screen; first and second main coils which are wound around a core and configured to defect in the vertical direction electron beams which have passed through a magnetic field generated by the first and second frame coils; first and second sub-coils which are wound around the core and configured to deflect in the vertical direction the electron beams which have passed through the magnetic field generated by the first and second frame coils; a first deflecting current supply portion configured to pass a serriform deflecting current to the first and second main coils; and a second deflecting current supply portion configured to supply to the first and second sub-coils through first and second diodes connected in parallel so as to have opposed directions a deflecting current which is supplied to the first and second main coils by the first deflecting current supply portion.

DETAILED DESCRIPTION OF THE INVENTION

Figure 1:
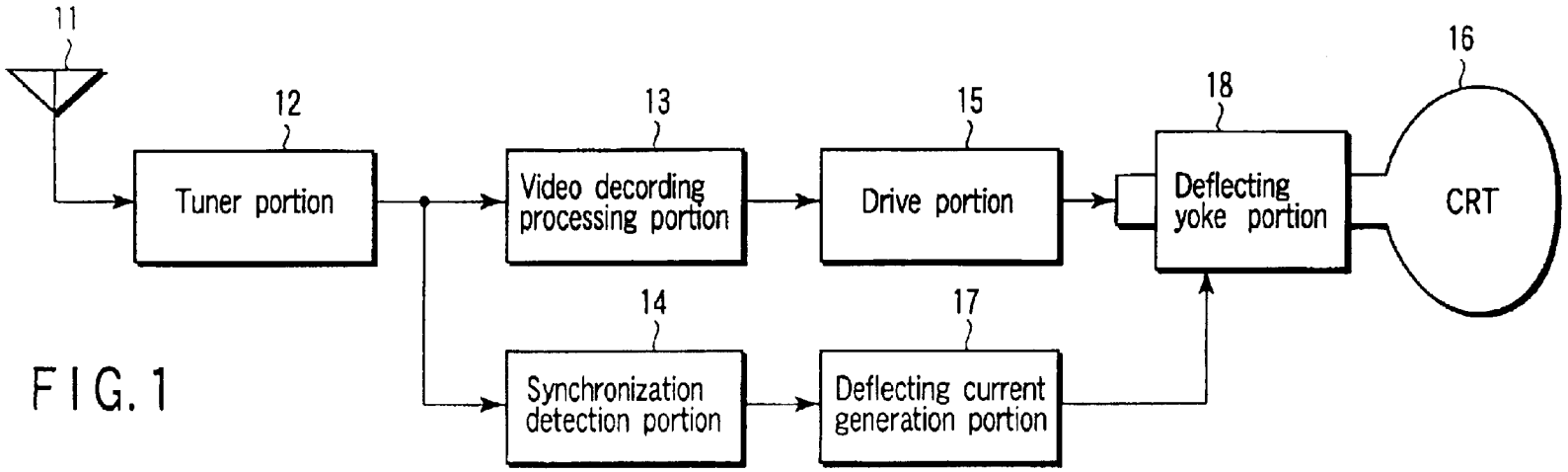
FIG. 1 shows a first embodiment according to the present invention, and it is a block structural view illustrating a television receiver.

A first embodiment according to the present invention will now be described in detail hereinafter with reference to the accompanying drawings. FIG. 1 shows a television receiver described in connection with the first embodiment. In FIG. 1, reference numeral 11 denotes an antenna. This antenna 11 receives a television broadcast signal and outputs it to a tuner portion 12.

This tuner portion 12 selects a television signal of a desired broadcast channel from the inputted television broadcast signal. Then, this tuner portion 12 outputs the selected television signal to a video decoding processing portion 13 and a synchronization detection portion 14.

Of these portions, the video decoding processing portion 13 extracts a video component from the inputted television signal and applies decoding processing to this component. Thereafter, it outputs a result to a CRT (Cathode Ray Tube) 16 through a drive portion 15.

Further, the synchronization detection portion 14 extracts respective horizontal and vertical synchronization components from the inputted television signal, and outputs them to a deflecting current generation portion 17. This deflecting current generation portion 17 generates respective horizontal and vertical deflecting currents from the respective inputted horizontal and vertical synchronization components, and outputs them to a deflecting yoke portion 18 of the CRT 16.

Then, the respective horizontal and vertical deflecting currents outputted from the deflecting current generation portion 17 are supplied to a horizontal deflecting coil and a vertical deflecting coil of the deflecting yoke portion 18. As a result, a video signal outputted from the drive portion 15 is displayed as a screen image in the CRT 16.

Figure 2:
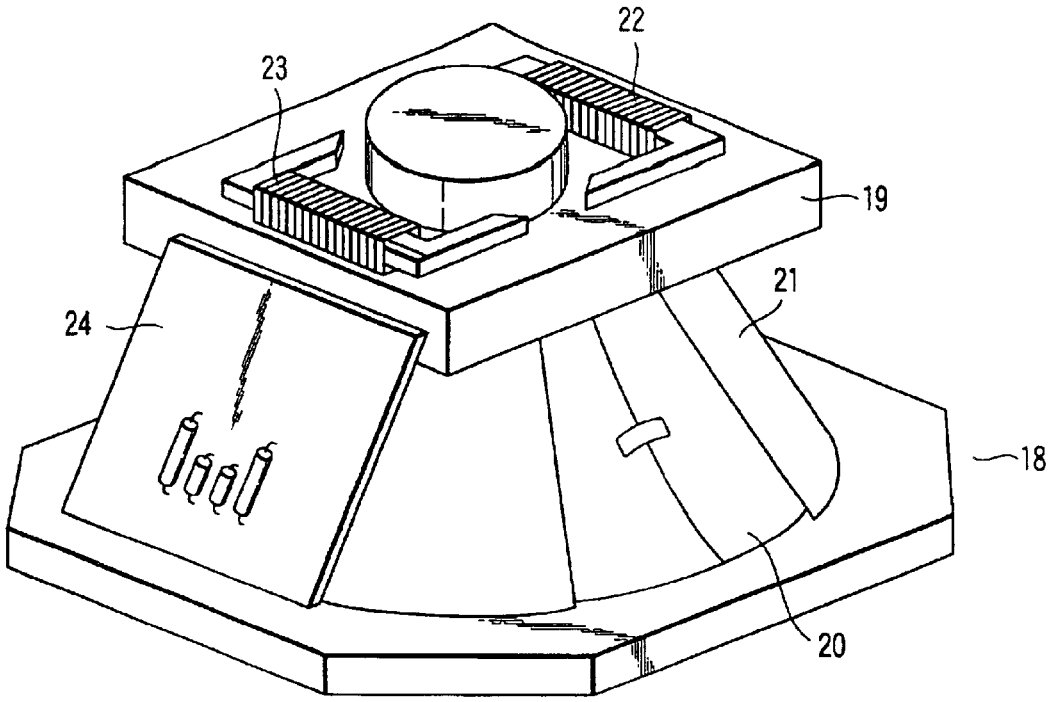
FIG. 2 is a perspective view illustrating an external appearance of a deflecting yoke portion in the television receiver.

FIG. 2 shows an external appearance of the deflecting yoke portion 18. This deflecting yoke portion 18 mainly comprises a separator 19 formed into a substantially conical shape having both opened ends, a horizontal deflecting coil (not shown) set on the inner side of this separator 19, an annular core 20 coaxially set on the outer side of the separator 19, and a toroidal type vertical deflecting coil 21 directly wound around this core 20.

Furthermore, a pair of frame coils 22 and 23 are set to the separator 19 of this deflecting yoke portion 18 at positions corresponding to upper and lower portions in a screen. Moreover, to the separator 19 of the deflecting yoke portion 18 is set a terminal plate 24 which is used to electrically connect the horizontal deflecting coil, the vertical deflecting coil 21 and the frame coils 22 and 23 and supply a current to these coils from the outside.

Figure 3:
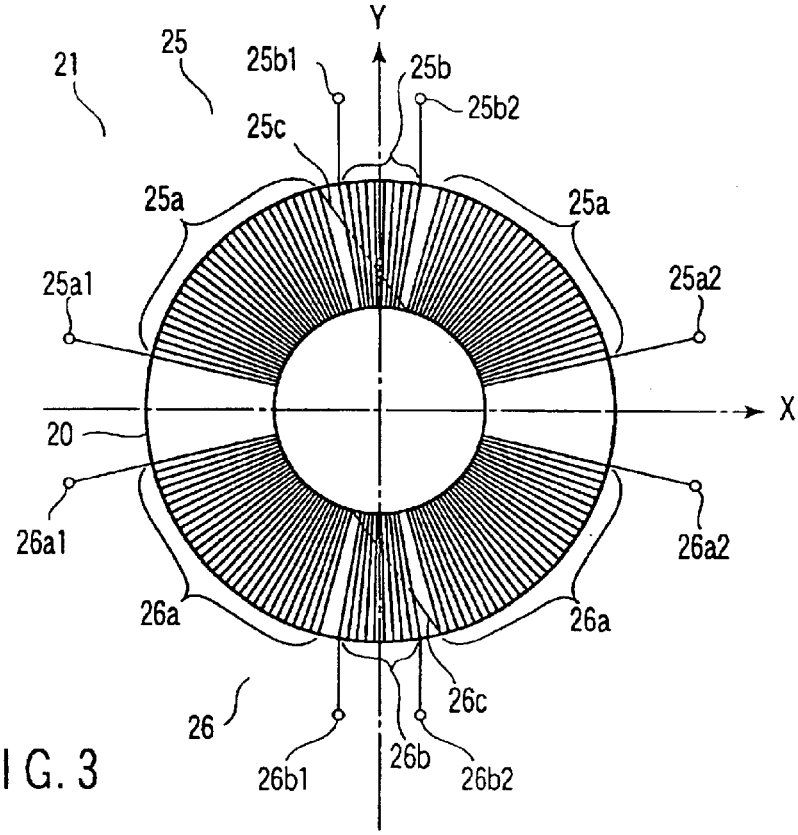
FIG. 3 is a view illustrating an example of how to wind a vertical deflecting coil in the deflecting yoke portion.

FIG. 3 shows the toroidal type vertical deflecting coil 21 wound around the core 20 seen from a screen side of the CRT 16. It is to be noted that a vertical direction is determined as a Y axis and a horizontal direction is determined as an X axis in the screen of the CRT 16.

That is, in a state that the core 20 is seen from the X-Y plane side, the vertical deflecting coil 21 comprises an upper vertical deflecting coil 25 which is wound around an upper part obtained when the core 20 is divided into two in the Y axis direction and which is in charge of vertical deflection of the upper side in the screen, and a lower vertical deflecting coil 26 which is wound around a lower part obtained when the core 20 is divided in two in the Y axis direction and which is in charge of vertical deflection of the lower side in the screen.

Additionally, the upper vertical deflecting coil 25 comprises an upper main coil 25*a* wound around the substantially entire upper part obtained when the core 20 is divided in two in the Y axis direction, and an upper sub-coil 25*b* which is wound around only the vicinity of the Y axis which divides the core 20 in two in the X axis direction of the upper part obtained when the core 20 is divided in two in the Y axis direction.

In this case, the upper main coil 25*a* is wound first, and the upper sub-coil 25*b* is wound around the upper layer of the upper main coil 25*a*. The upper main coil 25*a* has a coarse winding density at a part around which the upper sub-coil 25*b* is wound. In FIG. 3, only a transit portion 25*c* which cuts across the Y axis exists. Further, the upper sub-coil 25*b* is wound on this transit portion 25*c*.

Here, the both end portions of the upper main coil 25*a* are electrically connected with the terminal plate 24 through terminals 25*a*1 and 25*a*2. Furthermore, the both end portions of the upper sub-coil 25*b* are electrically connected with the terminal plate 24 through terminals 25*b*1 and 25*b*2.

On the other hand, the lower vertical deflecting coil 26 comprises a lower main coil 26*a* which is wound around the substantially entire lower part obtained when the core 20 is divided in two in the Y axis direction, and a lower sub-coil 26*b* which is wound around only the vicinity of the Y axis which divides the core 20 in two in the X axis direction of the lower part obtained when the core 20 is divided in two in the Y axis direction.

In this case, the lower main coil 26*a* is first wound, and the lower sub-coil 26*b* is wound around the upper layer of the lower main coil 26*a*. The lower main coil 26*a* has a coarse winding density at a part around which the lower sub-coil 26*b* is wound. In FIG. 3 only a transit portion 26*c* which cuts across the Y axis exists. Moreover, the lower sub-coil 26*b* is wound on the transit portion 26*c*.

Here, the both end portions of the lower main coil 26*a* are electrically connected with the terminal plate 24 through terminals 26*a*1 and 26*a*2. Additionally, the both end portions of the lower sub-coil 26*b* are electrically connected with the terminal plate 24 through terminals 26*b*1 and 26*b*2.

Figure 4:
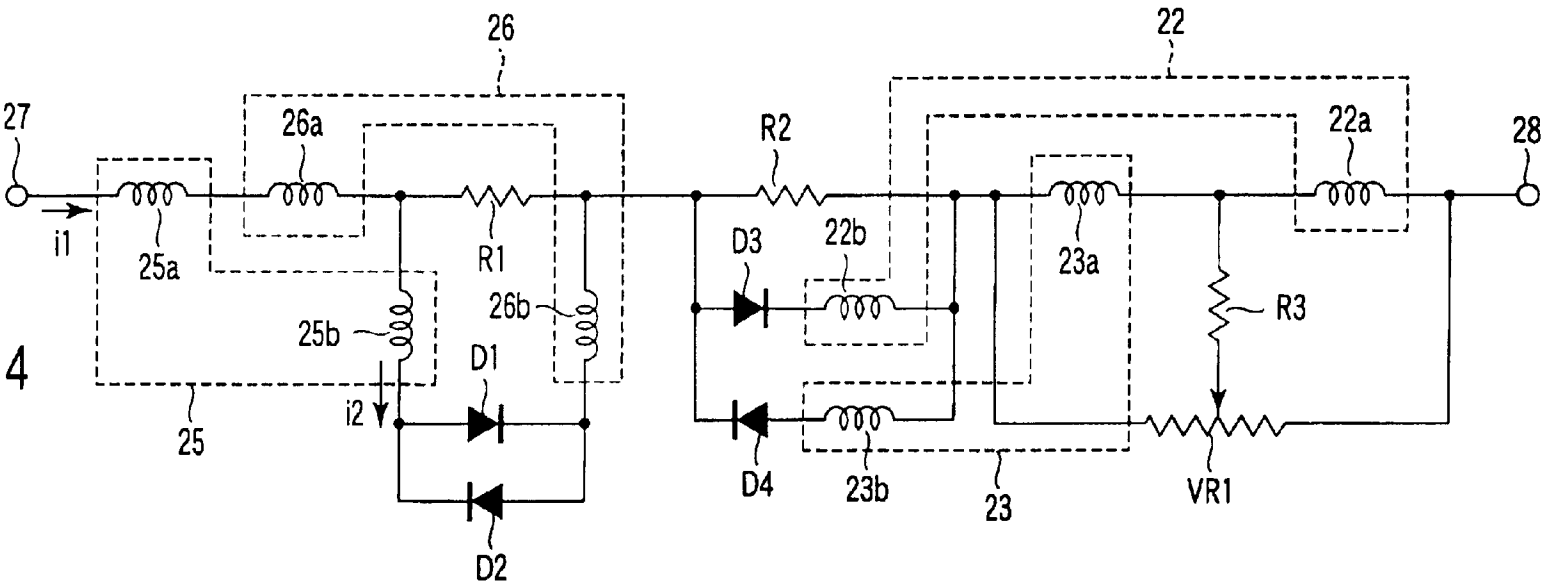
FIG. 4 is a circuit configuration view illustrating an example of an electrical connection state of a vertical deflecting coil and a frame coil in the deflecting yoke portion.

FIG. 4 shows an example of an electrical connection state of the frame coils 22 and 23, the upper vertical deflecting coil 25 and the lower vertical deflecting coil 26. That is, the upper main coil 25*a*, the lower main coil 26*a*, resistors R1 and R2, a VCR coil 23*a* as a part of the frame coil 23 and a VCR coil 22*a* as a part of the frame coil 22 are connected in series between two power supply terminals 27 and 28.

Furthermore, a contact between the lower main coil 26*a* and the resistor R1 is connected to one end of the upper sub-coil 25*b*. Moreover, a contact between the resistors R1 and R2 is connected with one end of the lower sub-coil 26*b*. Additionally, diodes D1 and D2 are connected in parallel between the other end of the upper sub-coil 25*b* and the other end of the lower sub-coil 26*b* in such a manner that these diodes D1 and D2 have the opposed directions.

Further, to the resistor R2 are connected a series circuit of a diode D3 having a shown polarity and a YH coil 22*b* as a part of the frame coil 22, and a series circuit of a diode D4 having a shown polarity and a YH coil 23*b* as a part of the frame coil 23.

Furthermore, a contact between the resistor R2 and the VCR coil 23*a* is connected to one end of a variable resistor VR1, and a contact between the VCR coil 22*a* and the power supply terminal 28 is connected to the other end of the variable resistance VR1. Moreover, a contact between the VCR coils 22*a* and 23*a* is connected to a traveling contact of the variable resistor VR1 through a resistor R3.

In the deflecting yoke portion 18 having the above-described structure, in regard to vertical deflection, electron beams emitted from an electron gun of the CRT 16 pass through a magnetic field generated by the frame coils 22 and 23, then pass through a magnetic field generated by the upper main coil 25*a*, the lower main coil 26*a*, the upper sub-coil 25*b* and the lower sub-coil 26*b*, and reach a fluorescent screen of the CRT 16.

Therefore, correction of the Y axis horizontal misconvergence YH is performed by the YH coils 22*b* and 23*b*, the upper main coil 25*a*, the lower main coil 26*a*, the upper sub-coil 25*b* and the lower sub-coil 26*b*. Incidentally, if a magnet or the like is arranged as well as these coils, correction is of course affected by this member.

Figure 5:
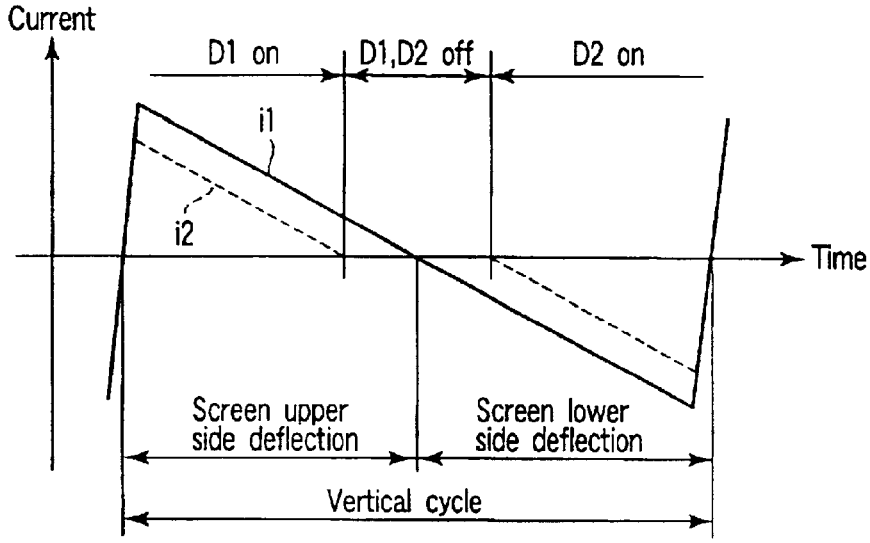
FIG. 5 is a view illustrating characteristics of a current flowing through the vertical deflecting coil in the deflecting yoke portion.

Here, when a predetermined voltage is applied between the power supply terminals 27 and 28 in order to supply a serriform deflecting current synchronized with a vertical cycle to the vertical deflecting coil 21, a current i1 flowing through the upper main coil 25*a* and the lower main coil 26*a* has characteristics such as indicated by a solid line in FIG. 5, and a current i2 flowing through the upper sub-coil 25*b* and the lower sub-coil 26*b* has characteristics such as indicated by a dotted line in FIG. 5.

That is, the current i1 having serriform characteristics flows through the upper main coil 25*a* and the lower main coil 26*a*, and the current i2 which has a rising timing different from that of the current i1 in accordance with ON/OFF of the diodes D1 and D2 and has pseudo-serriform characteristics flows through the upper sub-coil 25*b* and the lower sub-coil 26*b*. Moreover, a current which is like a half-wave-rectified current of the current i2 flowing through the upper sub-coil 25*b* and the lower-sub coil 26*b* flows through the YH coils 22*b* and 23*b*.

In such circumstances, the electron beams which have passed through the magnetic field generated by the frame coils 22 and 23 receive forces of a barrel-like magnetic filed generated by the upper main coil 25*a* and the lower main coil 26*a* and of a pincushion-like magnetic field generated by the upper sub-coil 25*b* and the lower sub-coil 26*b* by the ON/OFF (switching) control of the diodes D1 and D2.

Figure 6:
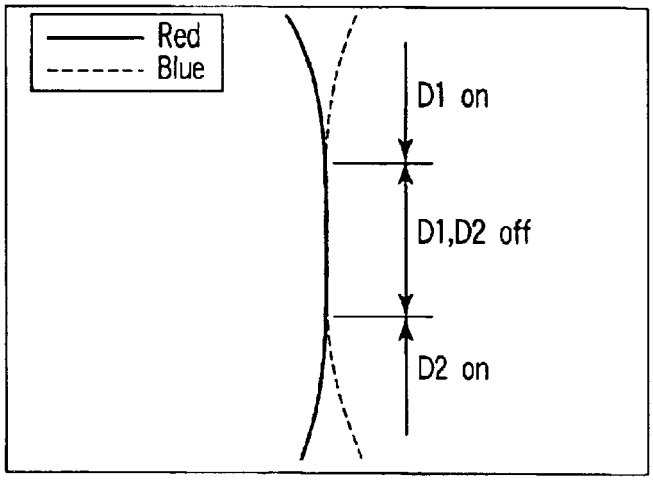
FIG. 6 is a view illustrating a correction of a Y axis horizontal misconvergence YH in the deflecting yoke portion.
Figure 7:
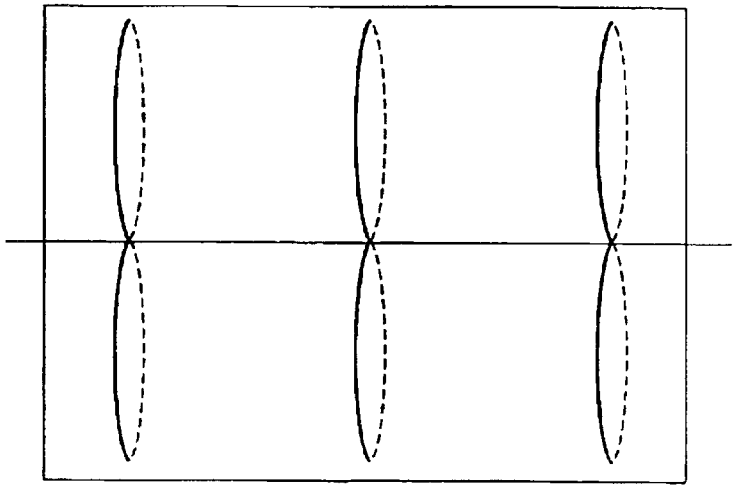
FIG. 7 is a view illustrating a Y axis horizontal misconvergence YH caused when a reverse current is led to a YH coil in a vertical retrace line period.

Based on the ON/OFF period of the diodes D1 and D2, e.g., if the OFF period is long, the correction of the Y axis horizontal misconvergence YH is carried out by the upper sub-coil 25*b* and the lower sub-coil 26*b* from a central portion in the screen as shown in FIG. 6. As a result, the Y axis horizontal misconvergence YH (see FIG. 7) generated due to a collapse in waveform of the current provoked when a reverse current is led to the YH coil in a vertical blanking period can be corrected to a practically sufficient level.

Therefore, by designing a YH correction quantity in the YH coils 22*b* and 23*b* so as to be reduced as much as possible in particular based on a combination of a design of a magnetic field distribution of the upper main coil 25*a* and the lower main coil 26*a*, a design of a magnetic field distribution of the upper sub-coil 25*b* and the lower sub-coil 26*b* and a design of a magnetic field distribution of the YH coils 22*b* and 23*b*, the Y axis horizontal misconvergence YH can be corrected to a practically sufficient level.

It is to be noted that the upper main coil 25*a* and the lower main coil 26*a* are wound first, and the upper sub-coil 25*b* and the lower sub-coil 26*b* are wound around the upper layers of these main coils in FIG. 3. However, as shown in FIG. 8, the upper sub-coil 25*b* and the lower sub-coil 26*b* may be wound first, and the upper main coil 25*a* and the lower main coil 26*a* may be wound around the upper layers of these sub-coils.

In this case, transit portions 25*c* and 26*c* which extend across parts of the upper main coil 25*a* and the lower main coil 26*a* where the upper sub-coil 25*b* and the lower sub-coil 26*b* exist cut across the upper sub-coil 25*b* and the lower sub-coil 26*b*.

Figure 8:
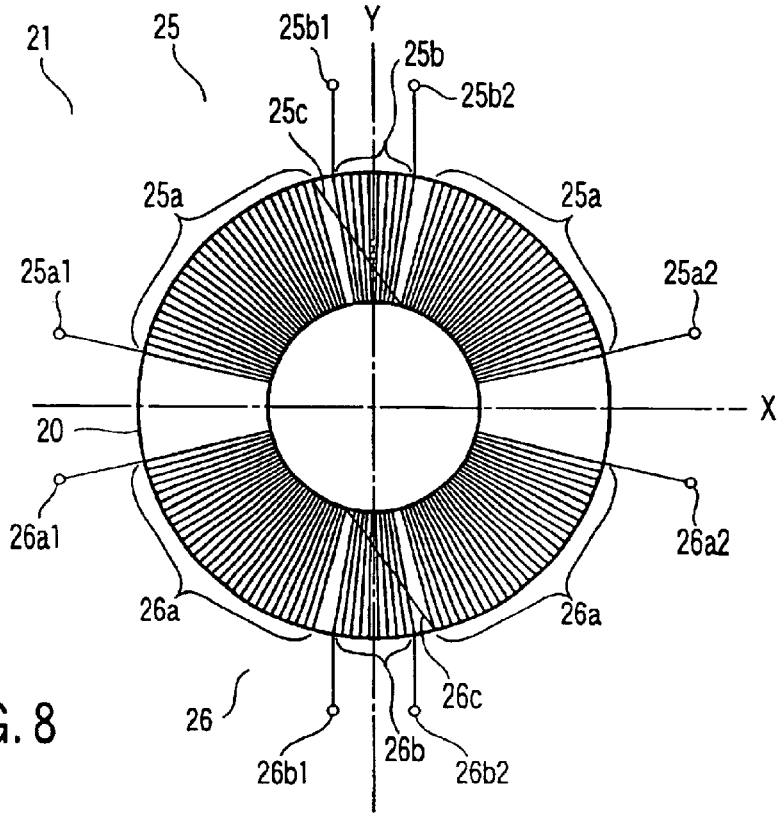
FIG. 8 is a view illustrating another example of how to wind the vertical deflecting coil in the deflecting yoke portion.

According to this winding method shown in FIG. 8, the same advantage as that of the winding method depicted in FIG. 3 can be obtained.

Figure 9:
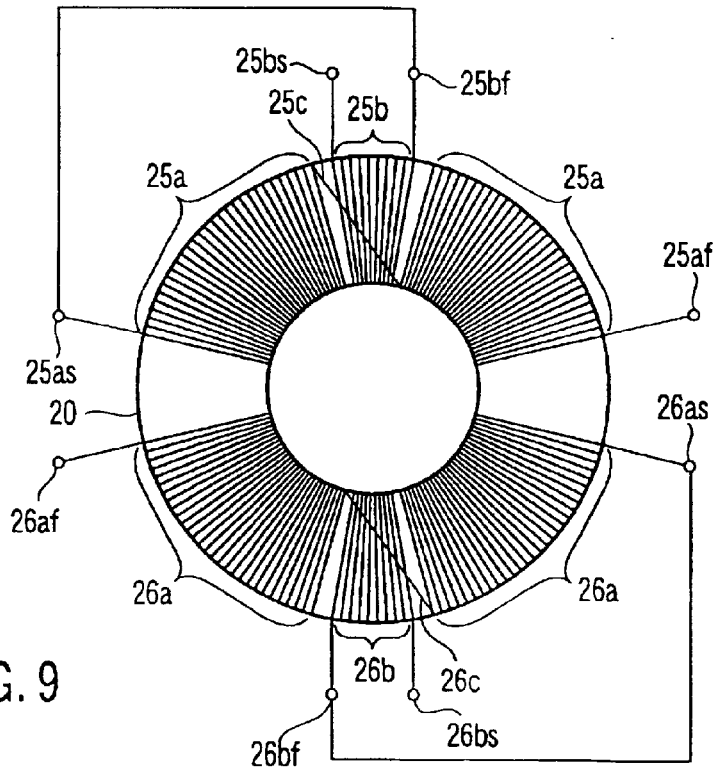
FIG. 9 shows a second embodiment according to the present invention, and it is a view illustrating an example of how to wind a vertical deflecting yoke in the deflecting yoke portion.

FIG. 9 shows a second embodiment according to the present invention. In FIG. 9, giving a description with like reference numerals denoting parts equal to those in FIG. 8, the upper main coil 25*a* and the upper sub-coil 25*b* are wound by using one conducting wire, and the lower main coil 26*a* and the lower sub-coil 26*b* are wound by using one conducting wire.

In regard to the upper main coil 25*a* and the lower sub-coil 25*b* of these coils, the conducting wire is wound around the core 20 from a winding start end 25*bs* of the upper sub-coil 25*b* by a predetermined number of turns, thereby forming the upper sub-coil 25*b*.

Thereafter, a predetermined length of the conducting wire is taken out from a winding trailing end 25*bf* of the upper sub-coil 25*b*, the conducting wire is led to a winding start end 25 as of the upper main coil 25*a*, the conducting wire is further wound around the core 20 from there by a predetermined number of turns in order to form the upper main coil 25*a* and it is caused to reach a winding trailing end 25*af*.

Moreover, in regard to the lower main coil 26*a* and the lower sub-coil 26*b*, the conducting wire is wound around the core 20 by a predetermined number of turns from a winding start end 26*bs* of the lower sub-coil 26*b*, thereby forming the lower sub-coil 26*b*.

Then, a predetermined length of the conducting wire is taken out from a winding trailing end 26*bf* of the lower sub-coil 26*b*, the conducting wire is led to a winding start end 26 as of the lower main coil 26*a*, the conducting wire is further wound around the core 20 from there by a predetermined number of turns in order to form the lower main coil 26*a* and it is caused to reach a winding trailing end 26*af*.

According to such a structure, in regard to the upper vertical deflecting coil 25, a connection part 25*bf*/25*as* between the winding trailing end 25*bf* of the upper sub-coil 25*b* and the winding start end 25 as of the upper main coil 25*a* can be clamped and connected to the terminal plate 24 at the same time. Additionally, as to the lower vertical deflecting coil 26, a connection part 26*bf*/26*as* between the winding trailing end 26*bf* of the lower sub-coil 26*b* and the winding start end 26*as* of the lower main coil 26*a* can be clamped and connected to the terminal plate 24 at the same time. Therefore, this winding method is effective for production.

Figure 10:
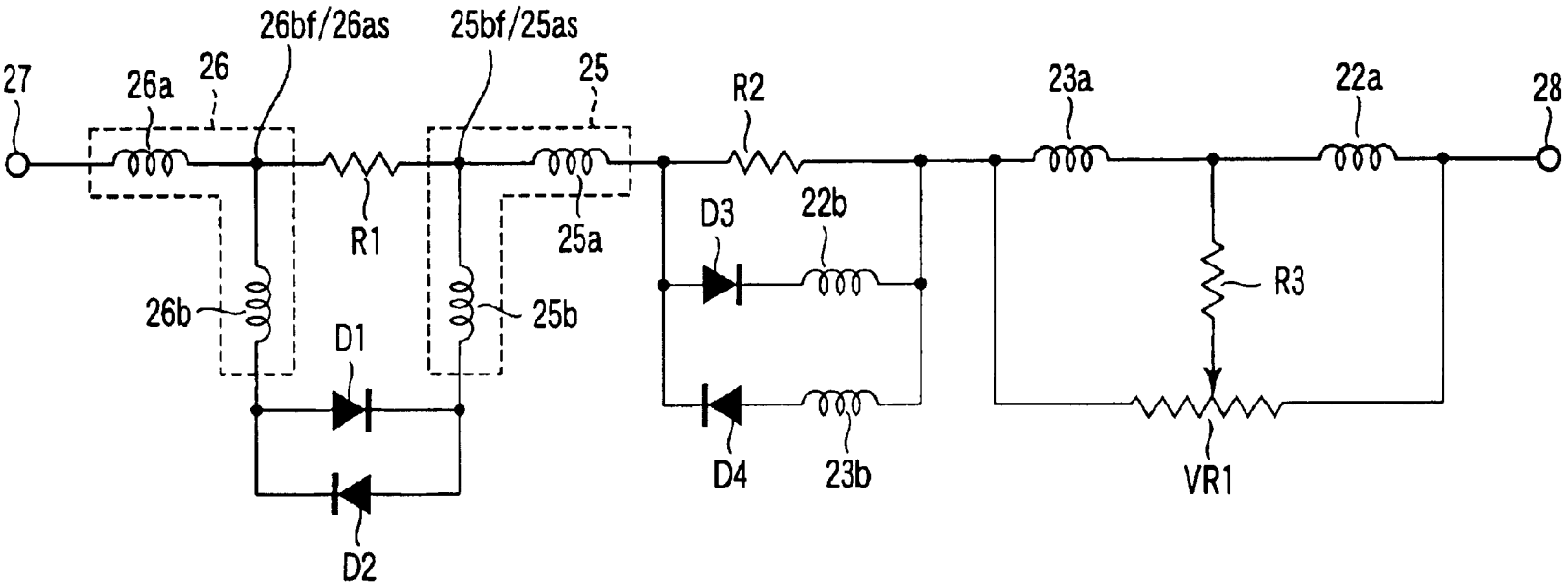
FIG. 10 is a circuit configuration view illustrating an example of an electrical connection state of the vertical deflecting coil and a frame coil in the deflecting coil portion.

FIG. 10 shows an example of an electrical connection state relative to the upper vertical deflecting coil 25 and the lower vertical deflecting coil 26 obtained by the winding method depicted in FIG. 9. In FIG. 10, giving a description with like reference numerals denoting parts equal to those in FIG. 4, a connection part 26*bf*/26 as between the winding trailing end 26*bf* of the lower sub-coil 26*b* and the winding start end 26 as of the lower main coil 26*a* is connected to one end of the resistor R1, and the other end of the lower main coil 26*a* is connected to the power supply terminal 27.

Further, a connection part 25*bf*/25*as* between the winding trailing end 25*bf* of the upper sub-coil 25*b* and the winding start end 25 as of the upper main coil 25*a* is connected to the other end of the resistor R1, and the other end of the upper main coil 25*a* is connected to one end of the resistor R2. Furthermore, the diodes D1 and D2 are connected in parallel between the other end of the lower sub-coil 26*b* and the other end of the upper sub-coil 25*b* in such a manner that these diodes D1 and D2 have the opposed directions.

It is to be noted that the upper sub-coil 25*b* and the lower sub-coil 26*b* are wound first and the upper main coil 25*a* and the lower main coil 26*a* are wound thereon. However, the upper main coil 25*a* and the lower main coil 26*a* may be wound first and the upper sub-coil 25*b* and the lower sub-coil 26*b* may be wound thereon.

Figure 11:
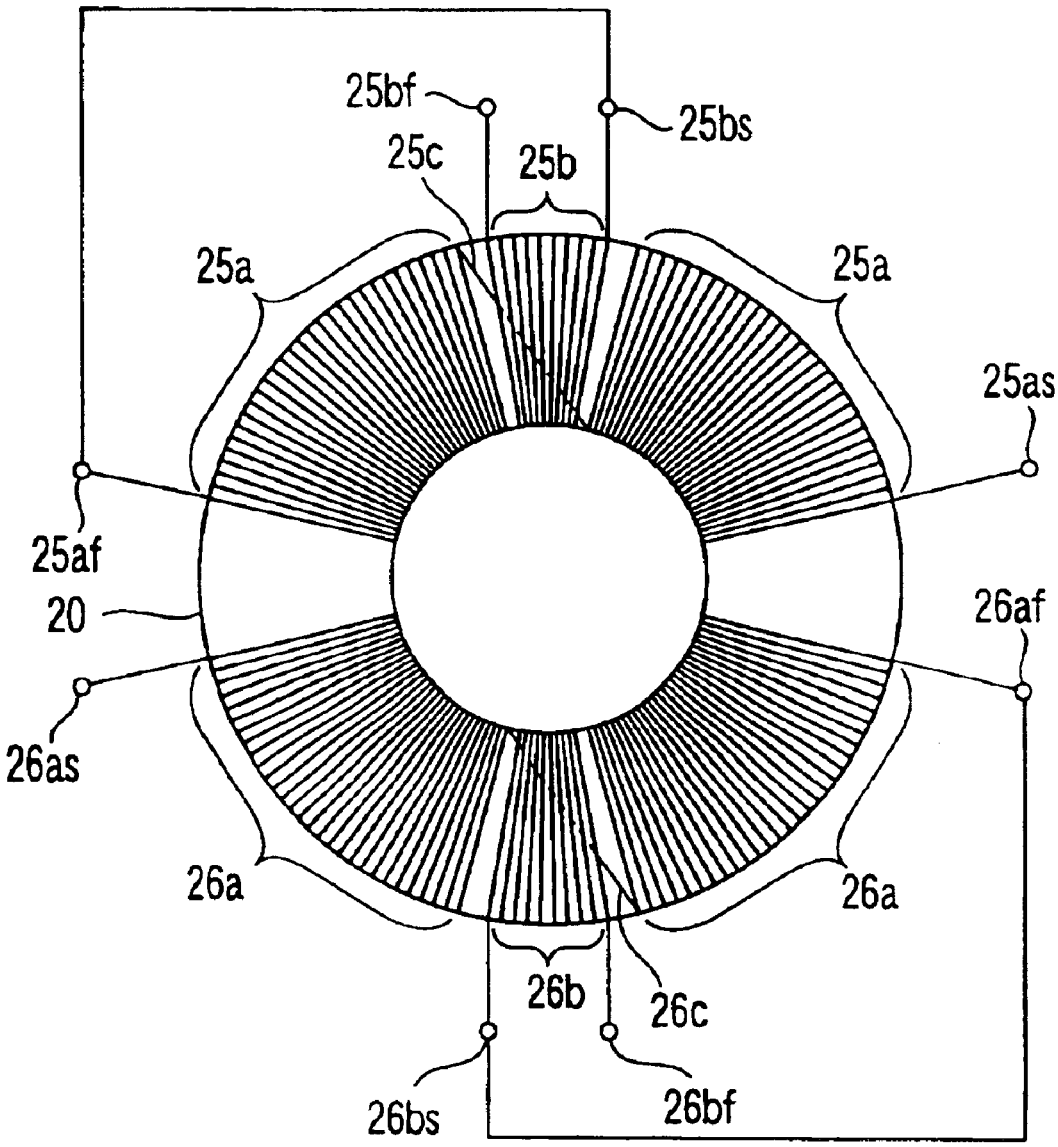
FIG. 11 is a view illustrating another example of how to wind the vertical deflecting coil in the deflecting yoke portion.

That is, as shown in FIG. 11, in regard to the upper main coil 25*a* and the upper sub coil 25*b*, the conducting wire is wound around the core 20 from the winding start end 25 as of the upper main coil 25*a* by a predetermined number of turns, thereby forming the upper main coil 25*a*.

Then, a predetermined length of the conducting wire is taken out from the winding trailing end 25*af* of the upper main coil 25*a*, the conducting wire is led to the winding start end 25*bs* of the upper sub-coil 25*b*, the conducting wire is wound around the core 20 from there by a predetermined number of turns in order to form the upper sub-coil 25*b* and it is caused to reach the winding trailing end 25*bf*.

Moreover, as to the lower main coil 26*a* and the lower sub-coil 26*b*, the conducting wire is wound around the core 20 from the winding start end 26 as of the lower main coil 26*a* by a predetermined number of turns, thereby forming the lower main coil 26*a*.

Then, a predetermined length of the conducting wire is taken out from the winding trailing end 26*af* of the lower main coil 26*a*, the conducting wire is led to the winding start end 26*bs* of the lower sub-coil 26*b*, the conducting wire is wound around the core 20 by a predetermined number of turns in order to form the lower sub-coil 26*b* and it is caused to reach the winding trailing end 26*bf*.

Based on this winding method shown in FIG. 11, the same advantage as that of the winding method depicted in FIG. 9 can be likewise obtained.

It is to be noted that the present invention is not restricted to the foregoing embodiments as it is, and constituent elements can be modified and embodied in many ways without departing from the scope of the invention on the embodying stage. Additionally, various types of inventions can be formed by appropriately combining a plurality of constituent elements disclosed in the foregoing embodiments. For example, some constituent elements can be deleted from all constituent elements shown in the embodiments. Further, constituent elements according to different embodiments may be appropriately combined.

What is claimed is:

1. A deflecting yoke apparatus comprising:

first and second frame coils configured to correct a vertical horizontal misconvergence in a screen;

first and second main coils which are wound around a core and configured to deflect in a vertical direction electron beams which have passed through a magnetic field generated by the first and second frame coils;

first and second sub-coils which are wound around the core and configured to deflect in the vertical direction the electron beams which have passed through the magnetic field generated by the first and second frame coils;

a first deflecting current supply portion configured to pass a serriform deflecting current to the first and second main coils; and a second deflecting current supply portion configured to supply to the first and second sub-coils through a first and second diodes connected in parallel so as to have opposed directions a deflecting current which is supplied to the first and second main coils by the first deflecting current supply portion.

2. A deflecting yoke apparatus according to claim 1, wherein the first deflecting current supply portion is configured to connect the first and second main coils in series between first and second terminals to which a predetermined voltage is applied, and the second deflecting current supply portion is configured to connect the first sub-coil, a parallel circuit of the first and second diodes, a series circuit of the second sub-coil and a resistor in parallel between the first and second terminals.

3. A deflecting yoke apparatus according to claim 1, wherein the first main coil and the first sub-coil are wound around the core by using a continuous conducting wire, and the second main coil and the second sub-coil are wound around the core by using a continuous conducting wire.

4. A deflecting yoke apparatus according to claim 3, wherein the first main coil and the first sub-coil are wound around the core in such a manner that a winding trailing end of the first sub-coil becomes continuous with a winding start end of the first main coil, and the second main coil and the second sub-coil are wound around the core in such a manner that a winding trailing end of the second sub-coil becomes continuous with a winding start end of the second main coil.

5. A deflecting yoke apparatus according to claim 3, wherein the first main coil and the first sub-coil are wound around the core in such a manner that a winding trailing end of the first main coil becomes continuous with a winding start end of the first sub-coil, and the second main coil and the second sub-coil are wound around the core in such a manner that a winding trailing end of the second main coil becomes continuous with a winding start end of the second sub-coil.

6. A deflecting yoke apparatus according to claim 3, wherein the first deflecting current supply portion is configured to connect the first and second main coils in series between first and second terminals to which a predetermined voltage is applied, and the second deflecting current supply portion is configured to connect the first sub-coil, a parallel circuit of the first and second diodes, a series circuit of the second sub-coil and a resistor in parallel between the first and second main coils.

7. A deflecting yoke apparatus according to claim 1, 2, 3, 4, 5 or 6, wherein the first main coil and the first sub-coil are respectively wound around parts of the core corresponding to an upper side in a screen in the vertical direction, and the second main coil and the second sub-coil are respectively wound around parts of the core corresponding a lower side in the screen in the vertical direction.

8. A deflecting yoke apparatus according to claim 7, wherein the first and second sub-coils are respectively wound around parts of the core corresponding to a vertical axis which divides the screen in two in the horizontal direction.

9. A deflecting yoke apparatus according to claim 7, wherein the first and second sub-coils are wound around the wound first and second main coils.

10. A deflecting yoke apparatus according to claim 7, wherein the first and second main coils are wound around the wound first and second sub-coils.

11. A television receiver comprising:

a reception portion configured to receive a television broadcast signal;

a signal processing portion configured to generate a video signal from the television broadcast signal received by the reception portion;

a deflecting current generation portion configured to generate a deflecting current from the television broadcast signal received by the reception portion;

a deflecting yoke portion configured to generate a magnetic field which deflects electron beams by using the deflecting current generated by the deflecting current generation portion; and a display portion configured to display the video signal generated by the signal processing portion as a screen image by deflecting the electron beams by using the magnetic field generated by the deflecting yoke portion, the deflecting yoke portion comprising:

first and second frame coils configured to correct a vertical horizontal misconvergence in the screen;

first and second main coils which are wound around a core and configured to defect in the vertical direction electron beams which have passed through a magnetic field generated by the first and second frame coils;

first and second sub-coils which are wound around the core and configured to deflect in the vertical direction the electron beams which have passed through the magnetic field generated by the first and second frame coils;

a first deflecting current supply portion configured to pass a serriform deflecting current to the first and second main coils; and a second deflecting current supply portion configured to supply to the first and second sub-coils through first and second diodes connected in parallel so as to have opposed directions a deflecting current which is supplied to the first and second main coils by the first deflecting current supply portion.

12. A television receiver according to claim 11, wherein the first deflecting current supply portion is configured to connect the first and second main coils in series between first and second terminals to which a predetermined voltage is applied, and the second deflecting current supply portion is configured to connect the first sub-coil, a parallel circuit of the first and second diodes, a series circuit of the second sub-coil and a resistor in parallel between the first and second terminals.

13. A television receiver according to claim 11, wherein the first main coil and the first sub-coil are wound around the core by using a continuous conducting wire, and the second main coil and the second sub-coil are wound around the core by using a continuous conducting wire.

14. A television receiver according to claim 13, wherein the first main coil and the first sub-coil are wound around the core in such a manner that a winding trailing end of the first sub-coil becomes continuous with a winding start end of the first main coil, and the second main coil and the second sub-coil are wound around the core in such a manner that a winding trailing end of the second sub-coil becomes continuous with a trailing start end of the second main coil.

15. A television receiver according to claim 13, wherein the first main coil and the first sub-coil are wound around the core in such a manner that a winding trailing end of the first main coil becomes continuous with a winding start end of the first sub-coil, and the second main coil and the second sub-coil are wound around the core in such a manner that a winding trailing end of the second main coil becomes continuous with a winding start end of the second sub-coil.

16. A television receiver according to claim 13, wherein the first deflecting current supply portion is configured to connect the first and second main coils in series between first and second terminals to which a predetermined voltage is applied, and the second deflecting current supply portion is configured to connect the first sub-coil, a parallel circuit of the first and second diodes, a series circuit of the second sub-coil and a resistor in parallel between the first and second main coils.

17. A television receiver according to claim 11, 12, 13, 14, 15 or 16, wherein the first main coil and the first sub-coil are respectively wound around parts of the core corresponding to an upper side in a screen in the vertical direction, and the second main coil and the second sub-coil are respectively wound around parts of the core corresponding to a lower side in the screen in the vertical direction.

18. A television receiver according to claim 17 wherein the first and second sub-coils are respectively wound around parts of the core corresponding to a vertical axis which divides the screen in two in the horizontal direction.

19. A television receiver according to claim 17, wherein the first and second sub-coils are wound around the wound first and second main coils.

20. A television receiver according to claim 17, wherein the first and second main coils are wound around the wound first and second sub-coils.

* * * * *